United States Patent [19]

Schultz

[11] 4,269,535

[45] May 26, 1981

[54] EARTH WORKING IMPLEMENT CONTROL SYSTEM

[75] Inventor: Gene Schultz, Fargo, N. Dak.

[73] Assignee: Earl W. Sornsin, Fargo, N. Dak. ; a part interest

[21] Appl. No.: 33,960

[22] Filed: Apr. 27, 1979

[51] Int. Cl.[3] ..... E01C 19/38

[52] U.S. Cl. ..... 404/117; 404/121; 404/128; 172/177; 172/744

[58] Field of Search ..... 404/117, 124, 122, 121, 404/128; 180/20; 172/177, 740, 744, 668, 662, 663, 795

[56] References Cited

U.S. PATENT DOCUMENTS

| | | | |
|---|---|---|---|
| 2,386,025 | 10/1945 | Wills | 404/128 X |
| 2,721,405 | 10/1955 | Gardner | 404/128 X |
| 2,830,511 | 4/1958 | Wills | 404/128 X |
| 2,874,948 | 2/1959 | Bjorkman | 404/128 X |
| 3,042,122 | 7/1962 | Anderson | 172/265 |
| 3,277,802 | 10/1966 | Petersen | 404/121 |
| 3,291,013 | 12/1966 | Stolp | 404/128 |
| 3,321,031 | 5/1967 | Evans | 172/605 |
| 3,422,735 | 1/1969 | Vitry | 404/117 |
| 3,477,535 | 11/1969 | Wyatt | 180/20 |
| 3,642,674 | 2/1972 | Geurts | 172/261 |
| 3,768,583 | 10/1973 | Waterman | 404/122 X |
| 3,924,689 | 12/1975 | Manor | 172/780 |
| 3,993,413 | 11/1976 | Cox | 404/128 |
| 4,031,966 | 6/1977 | Farrell | 172/794 |

*Primary Examiner*—Nile C. Byers, Jr.

*Attorney, Agent, or Firm*—Schroeder, Siegfried, Ryan, Vidas, Steffey & Arrett

[57] ABSTRACT

An operating and down-pressure hydraulic control system for vehicle-mounted implements such as earth compactors and the like. The assembly of hydraulic cylinders, valving and a hydraulic accumulator provided herein operates as a hydraulic system to raise, lower and otherwise position an implement and to provide down-pressure to it. The assembly also permits the hydraulic support of the implement to flex, while maintaining down-pressure on it, when the ground surface elevation rises or falls away relative to the implement as it moves over the ground being worked.

26 Claims, 11 Drawing Figures

EARTH WORKING IMPLEMENT CONTROL SYSTEM

DESCRIPTION

Background of Prior Art

This invention relates to earth working implements and particularly to hydraulic control means therefor. More specifically the invention concerns novel control means for implements such as earth compactors and the like to not only raise and lower the implement but to provide controlled down-pressure on the implement when it is attached to a vehicle by means of a pivotable mount means such as a hitch, particularly and preferably a three or four point hitch.

Hydraulically controlled implements connected to a vehicle such as a tractor or the like are normally "locked" in a fixed operating condition and position relative to the vehicle carrying them unless the implements are in a floating condition, permitted usually by a control valve with a "float position" detent. The "locked" operating condition is utilized for working with the implement in an earth working position. However, a "locked" operating position/condition in the case of many implements such as earth compactors is not desirable because uneven ground surface puts excessive pressure on the implement, as when the surface rises, or there is in some cases, as when the ground surface falls away from the implement, no ground contact at all. For example, with an earth compactor carried by a vehicle, as the elevation of the earth surface being worked varies, the ground may fall away from the compactor or rise up against the compactor. In the latter case, excessive pressure may be placed on the compactor and in the former case there may, at times when the ground falls away rapidly from the compactor, be no contact between the compactor and the ground surface at all. To prevent excessive pressure on such implements when the elevation of the ground rises excessively, a safety release mechanism is usually designed into the hydraulic system to allow the implement to automatically force the control system from the "locked" working condition into the floating condition. However, when this happens, no down-pressure is available from the implement, such as a compactor, to bear against the ground and no working of the earth, such as compaction or other working, results.

BRIEF SUMMARY OF THE INVENTION

The control apparatus of the present invention provides an improvement in this art in that it is specifically designed to provide, in addition to the "hold" or "off", "down", "up" and "float" conditions or positions, a controlled down-pressure condition against an earth compactor or other implement carried on a vehicle by a pivotable mount means such as a hitch, particularly a three or four point hitch. The incorporation of a hydraulic accumulator means into the hydraulic control system with special valving arrangements to control hydraulic fluid pressures in the system allows the compactor or other controlled implement to be raised, lowered, placed in a "float" condition and in a working position in which a predetermined loading can be continuously applied against the implement, and hence the ground, from the vehicle while still allowing the implement support system of flex, compensating for uneven ground.

BRIEF DESCRIPTION OF THE DRAWINGS

FIG. 2 showing the earth compactor in a "down" position and "float" condition; FIG. 2*a* showing the compactor in the "down" position with "down-pressure" provided according to the invention; and FIG. 2*b* showing the compactor in a "raised" position.

DETAILED DESCRIPTION OF THE INVENTION

Figure 1:
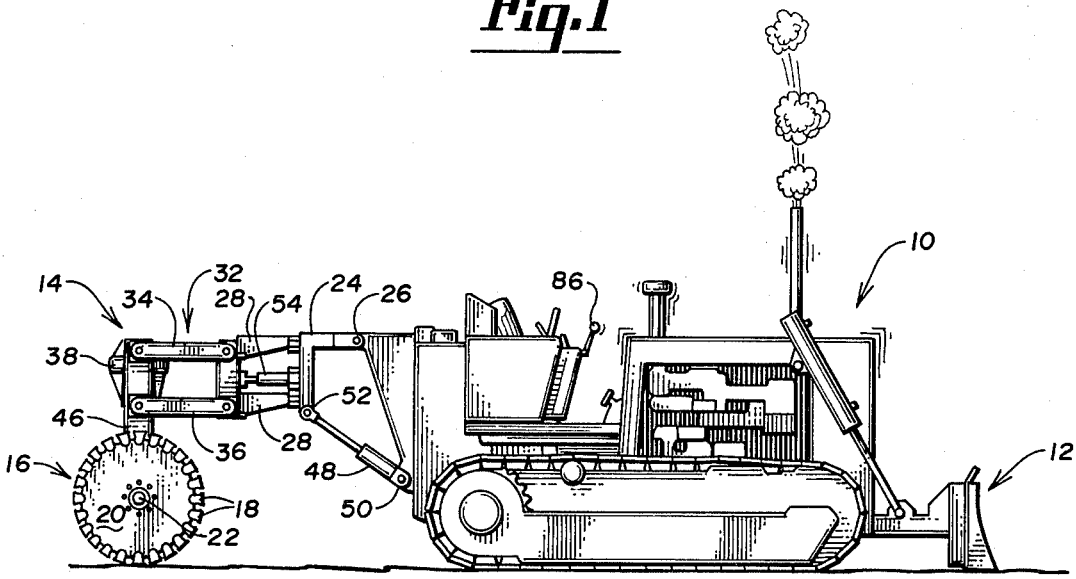
FIG. 1 is a side elevation of a bulldozer equipped with a rear mounted earth compactor according to the invention. Structural relationship of parts and relative sizes are exaggerated for purposes of clarity. Ideally, the compactor is as close to the tractor as possible.
Figure 6:
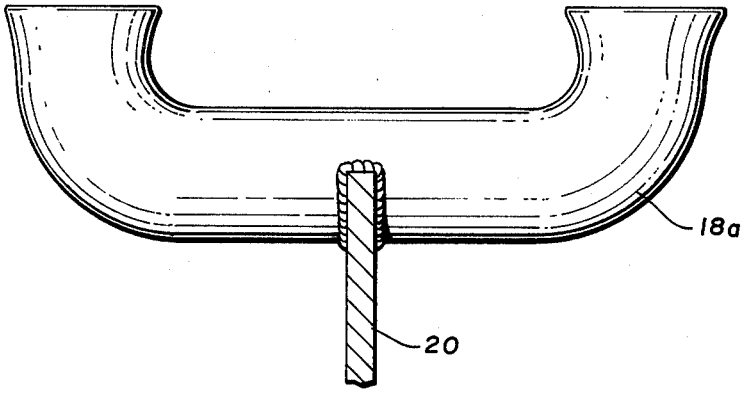
FIG. 6 is a detail taken from FIG. 3 showing an elongated sheep's foot compactor element.
Figure 7:
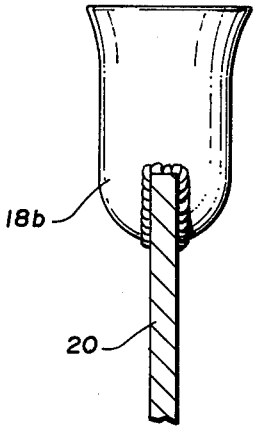
FIG. 7 is a detail taken from FIG. 3 showing a view of a single sheep's foot element.

In the drawing, like reference characters designate similar parts in the several views.

Figure 2:
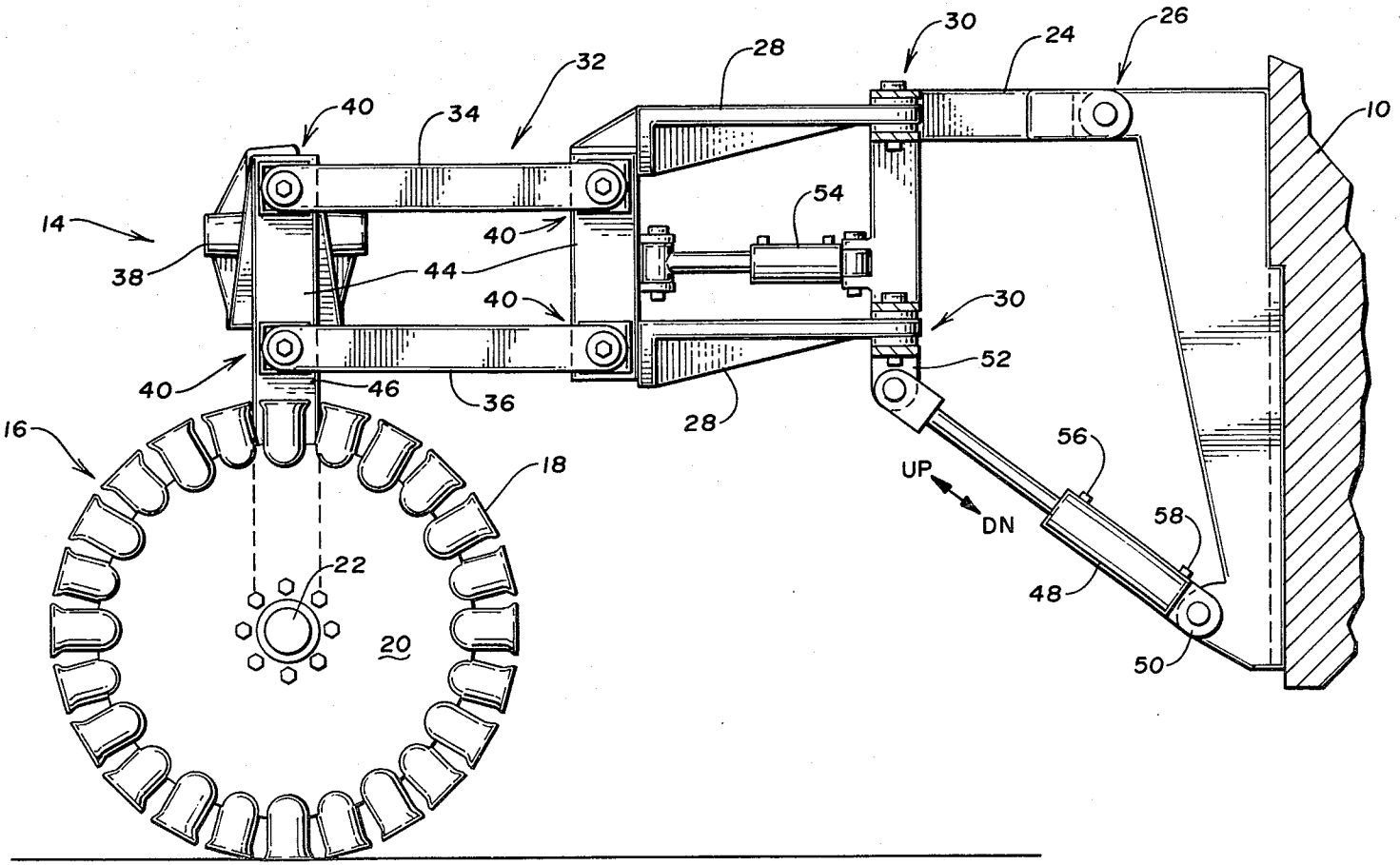
FIGS. 2, 2*a* and 2*b* are side elevations of the earth compactor and mounting arrangement shown in FIG. 1.

Referring now to the drawing and first most specifically to FIGS. 1 and 2 there is shown a self-propelled vehicle, specifically a bulldozer generally designated by 10, having an implement such as the standard hydraulically controlled blade, generally designated by 12, at the forward end thereof. At the rear of dozer 10 is another implement generally designated 14 which takes the preferred form of an earth compactor including a rotatably mounted sheep's foot compaction device 16 having three sets of rotatably mounted sheep's foot compaction wheels, individually designated 18. Elements 18 are circularly arranged in a wheel-like form and carried by discs or hubs 20 which rotate on an axle 22 when the compactor is pulled or pushed or otherwise moved over the ground. Other implements may be used as well as other types of compactors such as a drum compactor or a plate compactor.

The vehicle carrying the compactor does not have to be self-propelled and may be one which is trailed. As shown in the Figures, the compactor implement is specifically disclosed for use supplemental to the primary implement or bulldozer blade 12 is mounted on the rear of dozer 10. However, the compactor or any other earth working implement may be used alone as the primary implement on a vehicle in accordance with the invention and further may be mounted either forwardly or rearwardly thereof.

Figure 5A:
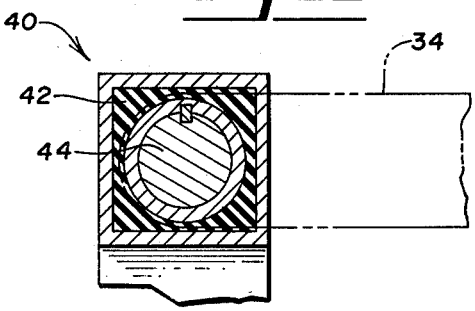
FIGS. 5*a* and 5*b* are cross-sections taken along lines 5—5 in FIG. 3 showing construction detail of the vibration isolation mounting for the vibrator on the compactor, FIG. 5*a* showing a normal position and FIG. 5*b* showing a flexed position.
Figure 5B:
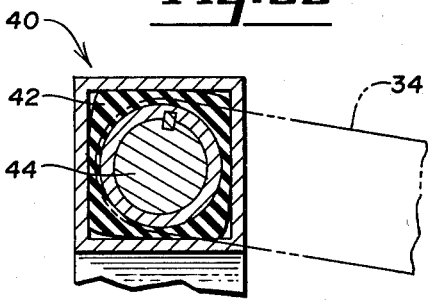

In its preferred use, as shown in FIGS. 1 and 2 it is rearwardly carried on a self-propelled vehicle such as tractor or dozer 10 by a connecting means which may include, as shown in the Figures, a four point hitch comprising a support frame 24 pivotably attached to vehicle 10 by pivot joints 26. Additional support means 28 is pivotably carried by frame 24 to rotate on an axis substantially normal and vertical relative to the horizontal pivotable axis of pivotable joints 26 by means of a centrally located pair of pivot joints 30. A supplemental support means and vibration isolating means, generally designated by 32 is attached to support means 28 and includes a box-like structure formed by upper and lower side arms 34 and 36 which are so arranged as to support a vibrator 38 which may be any of the types known in the art. For example, the hydraulically driven "Vibra-Power" drive available from Davis Manufacturing, a Division of JI CASE, A Tenneco Company, Witchita, Kansas 67201, may be used. Such a vibrator includes, but not specifically shown herein, a set of weights rotatably mounted on shafts for synchronized fly wheel action to cause a vibratory result when rotated. To isolate vibration produced by vibrator mechanism 38 from vehicle 10, arms 34 and 36 are mounted in rubber joints indicated at 40 and more specifically shown in FIGS. 5*a* and 5*b*. The rubber or other elastomer-type material 42 resiliently supports arms 34 and 36 are generally U-shaped cross-connector end members 44 in a resiliently rigid fashion as is already known in the art and shown in the normal position in FIG. 5*a*. In FIG. 5*b*, the arms and end members are subjected to vibration as shown and flex the elastomer.

The compactor also includes axle supports 46 which depend from the unit as shown to rotatably carry the sheepsfoot units 16.

Figure 8:
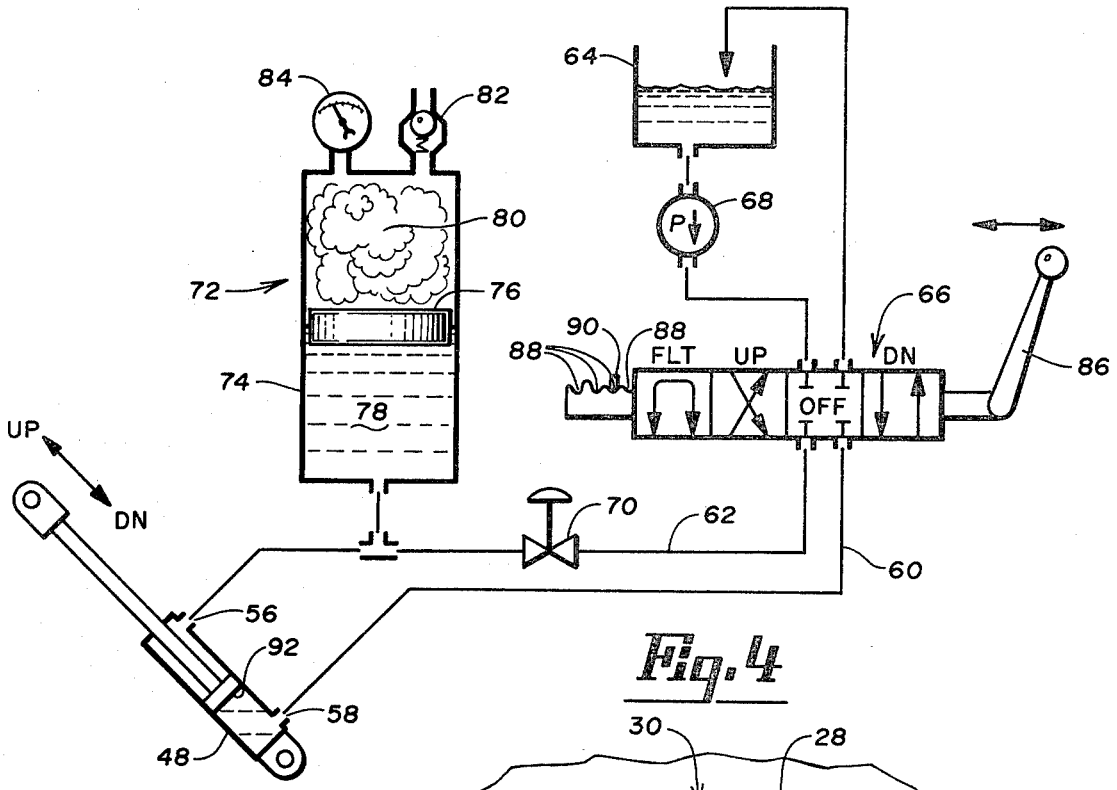
FIG. 8 is a schematic diagram of the hydraulic control system according to the invention.
Figure 4:
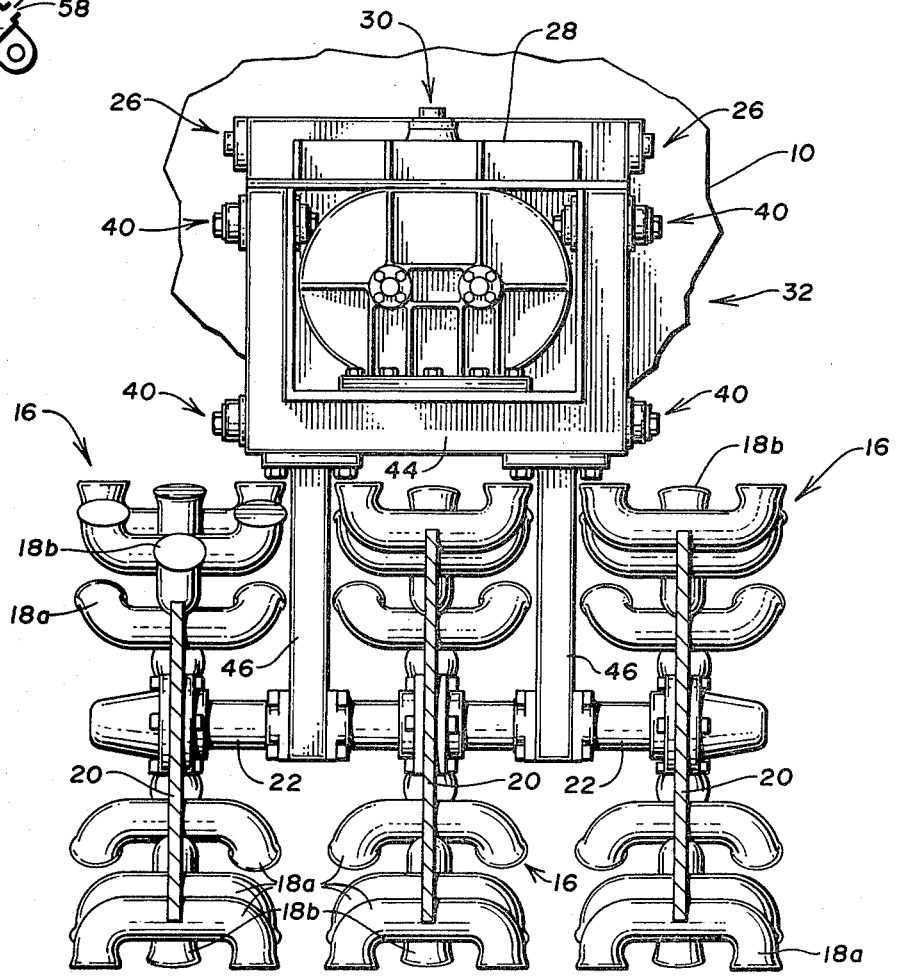
FIG. 4 is a rear elevation of the earth compactor shown in FIG. 1 also showing the placement of a vibrator and the sheep foot compactors and mounting therefor on the earth compactor, portions of the overall apparatus and system are cut away for better visability.

Raising and lowering means for the compactor comprise hydraulic cylinder means such as a pair of hydraulic cylinders 48 connected between a support portion of vehicle 10 as at 50 and the implement or compactor support frame 24 at 52. The pair of hydraulic cylinders 48 are arranged one to each side of the implement so as to raise the entire implement 14 from the ground when cylinders 48 are extended as shown in FIG. 2*b* and to lower implement 14 to the ground when the cylinders 48 are contracted as shown in FIG. 2, thus providing a raised and lowered position for the implement relative to the ground surface to be worked. Selective positioning of the implement by the operator of the vehicle is thus provided. The hydraulic control system for cylinders 48 is shown in FIG. 8 and will be described in detail hereinbelow.

Figure 3:
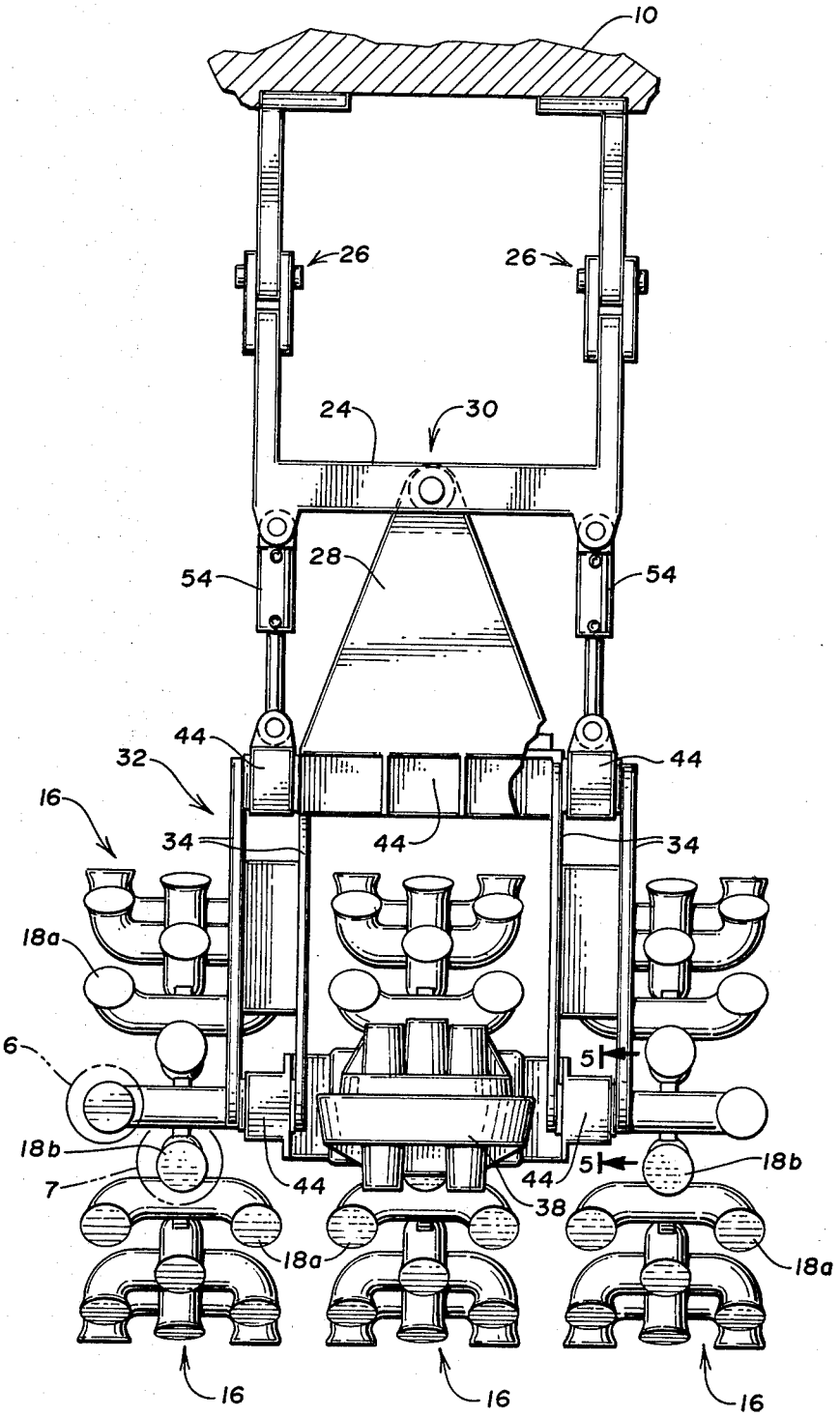
FIG. 3 is a plan view of the earth compactor and mounting arrangement according to the invention, also showing the provision for compact steering by means of a pair of steering cylinders.

Preferably, the compactor form of the invention disclosed will also include a pair of hydraulic steering cylinders 54 arranged as shown in FIGS. 2 and 3 to rotate the compactor in a horizontal plane about pivot 30 by means of a standard hydraulic supply system (not shown) for selectively controlling hydraulic cylinders 54 and orienting the compactor according to the operators' desire. Preferably, as shown, hydraulic cylinders 54 will comprise a pair of cylinders extending between support member 24 and support member 44.

Generally speaking, from the above description it can be seen that there is provided an earth working implement, such as an earth compactor, which can be raised from the ground and lowered to the ground to a ground working position by one set of hydraulic cylinders and turned in a horizontal plane i.e., steered, by another set of hydraulic cylinders by the operator as he is operating the vehicle 10. As will be described in detail hereinbelow, the hydraulic control system will preferably be controlled from the operator driver's seat and portions of the hydraulic system will, therefore, be carried on the vehicle within convenient reach by the operator.

Figure 2A:
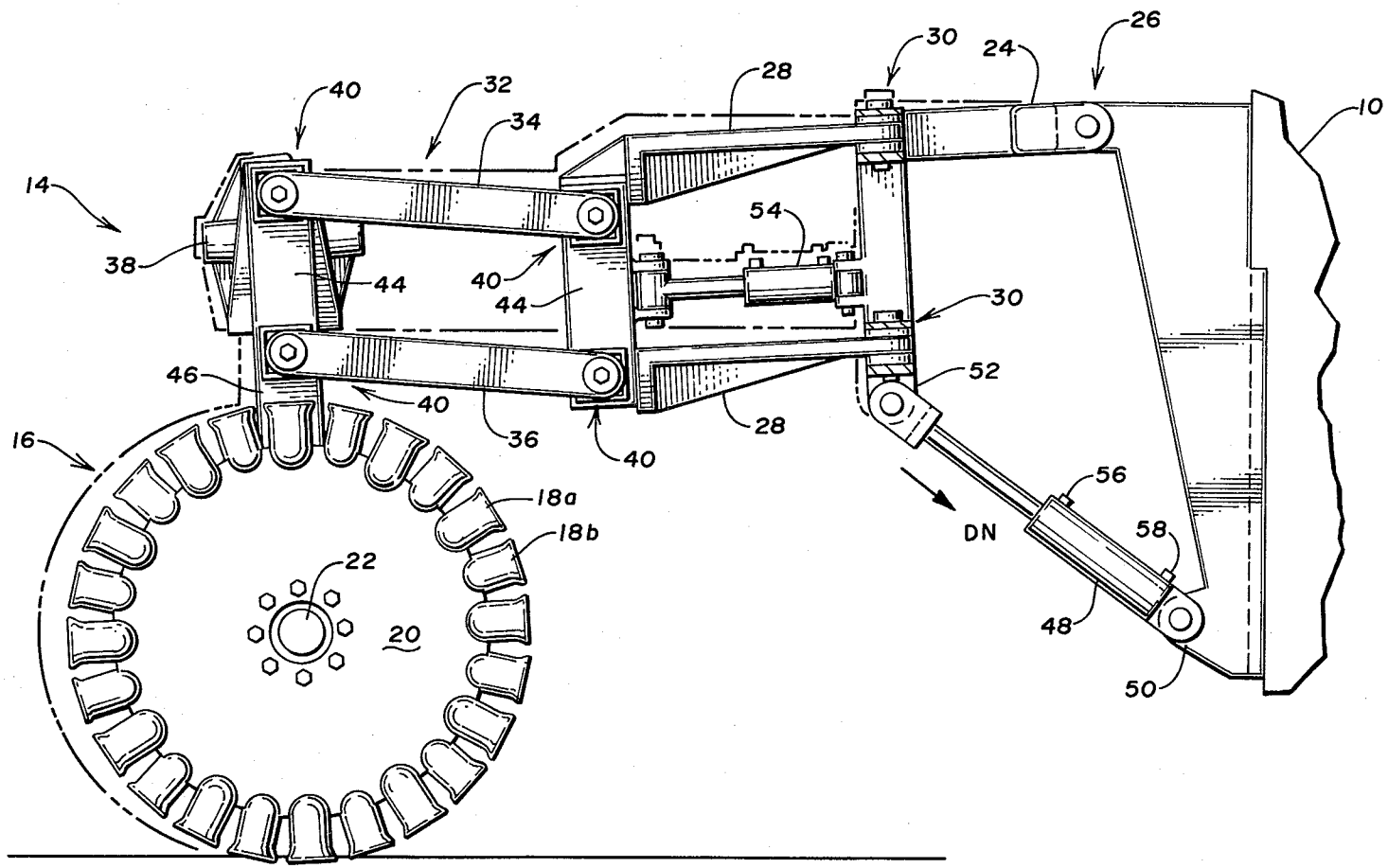
Figure 2B:
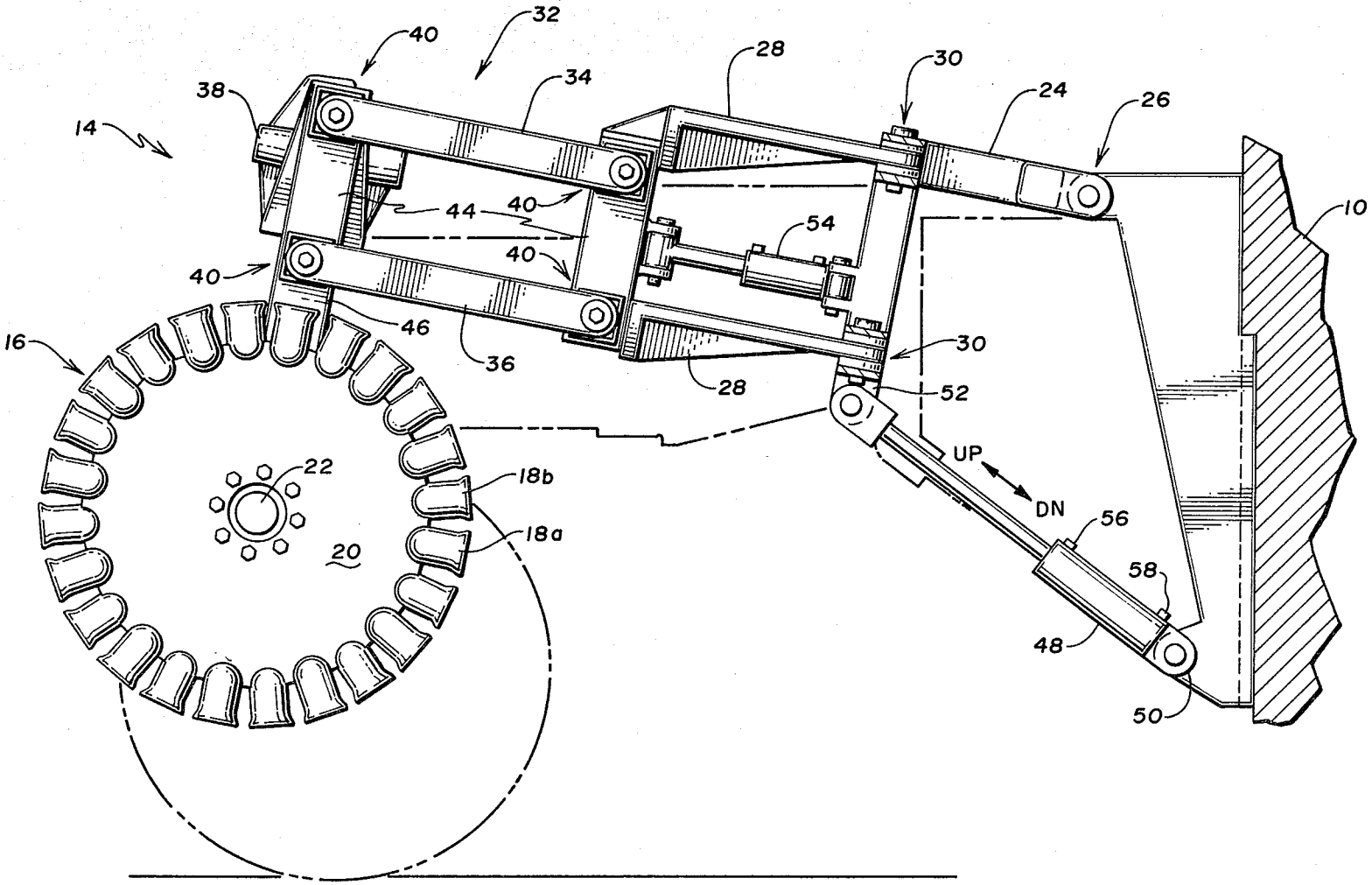

Referring now specifically to FIGS. 2, 2*a* and 2*b*, a few general comments are made by way of introduction to the hydraulic control system of the invention. Hydraulic cylinders 48 include hydraulic conduit connection means or ports 56 and 58 by means of which a supply of hydraulic fluid pressure may be selectively applied to hydraulic cylinder 48. For example, applying hydraulic fluid pressure at 56 may cause hydraulic cylinder 48 to contract and pull the compactor to the lowered or ground working position as shown in FIG. 2 whereas the application of hydraulic fluid pressure at 58 may cause the hydraulic cylinder to extend as shown in FIG. 2*b* thereby raising the implement away from the ground. The phantom line in FIG. 2*b* shows the implement in the ground working position or lowered position. Also, greater hydraulic fluid pressure applied at 56 would cause hydraulic cylinders 48 to contract even more than is shown in FIG. 2 to provide the condition shown in FIG. 2*a* whereby positive down-pressure may be applied to the compactor through the hydraulic system to exert leverage and weight from the vehicle through the compactor to the earth's surface. This function of the hydraulic system is controlled as is described in more detail hereinbelow. The phantom line of FIG. 2*a* shows the difference between the down-pressure position and the float position or down position of FIG. 2.

Referring now specifically to FIG. 8, the hydraulic control system of the invention as previously pointed out includes hydraulic cylinders 48 (only one of which is shown for simplicity) to which are connected first hydraulic conduit means 60 and second hydraulic conduit means 62. The flow of hydraulic fluid from reservoir 64 is controlled by a first valve means generally indicated by 66. A pump 68 is connected between hydraulic fluid reservoir 64 and valve means 66 to provide hydraulic fluid pressure in the system. Second hydraulic conduit means 62 also includes a second valve means 70 connected between first valve means 66 and port 56 on hydraulic cylinder 48. Additionally, there is included in second conduit means 66 between second valve means 70 and port 56 on hydraulic cylinder 48 a hydraulic pressure accumulator means generally indicated at 72.

Hydraulic pressure accumulator means 72 includes a pressure container 74 inside of which a piston 76 is carried for reciprocating movement in the container. Piston 76 divides container 74 into a first chamber 78 for receiving hydraulic fluid from second conduit means 62 and a second chamber or bias pressure chamber 80. Bias pressure chamber 80 is adapted by means of check valve controlled inlet 82 to be supplied with a predetermined compressed fluid such as compressed air or a compressed inert gas such as nitrogen to provide a predetermined biasing pressure against piston 76. Gauge 84 may be included for monitoring the pressure in chamber 80. It can be seen that piston 76 is exposed to pressure on one side from the pressurized hydraulic fluid in chamber 78 and to pressure from the other side by the biasing pressure of the compressed gas in chamber 80 whereby piston 76 is positionally responsive inside container 74, tending to seek a balanced position between the two pressures.

Second valve means 70 will preferably take the form of a manual on-off valve which will be disposed on vehicle 10 within convenient reach of the operator as will first valve means 66.

First valve means 66 comprises a multi-position valve (shown schematically) which has four operating positions as schematically indicated in the Figure. Lever 86 may be used to move the valve closure member (not shown) between various selected positions within the valve housing as indicated by the four detents 88 and detent stop 90. As indicated, valve 66 will have four control positions for controlling the flow of hydraulic fluid in hydraulic fluid conduit means 62 and 60. The various control positions of valve 66 are schematically indicated in the Figure and include a "down" position in which hydraulic fluid is caused to flow through hydraulic conduit 62 into hydraulic cylinder 48 via port 56 and to return to reservoir 64 via port 58 on hydraulic cylinder 48 and first hydraulic fluid conduit means 60. When valve 66 is in this position, valve 70 will normally be maintained open. This flow pattern causes cylinder 48 to contract.

The valve includes a "hold" or "off" position in which it permits no flow either from or to the hydraulic reservoir. This position may also be referred to as the "hold" position.

When valve 66 is placed in a third or "up" position it allows the flow of hydraulic fluid from the reservoir through first hydraulic conduit means 60 into hydraulic cylinder 48 via port 58 causing hydraulic cylinder 48 to extend. The fluid then returns to valve 66 via port 56 and second hydraulic conduit means 62, manual valve 70 being normally opened in this condition.

In the last or "float" position, manual valve 70 is closed and valve 66 allows constant hydraulic pressure to be applied by pump 68 through first hydraulic conduit means 60 to hydraulic cylinder 48 and through that portion of the second hydraulic conduit means 62 leading to the hydraulic fluid pressure chamber 78.

As previously stated, the valve is only shown schematically as to its structure.

Four Position Normally Open Valves with Float Detent are commercially available from the Gresen Manufacturing Company, Post Office Box 1313, 600 Hoover Street, NE, Minneapolis, Minnesota 55413, as Model No. 400 Series, SP Series and WP Series. These valves are typical examples of the types of control valves which can be used with this invention. The valves listed are of various capacities and would be selected depending on the gal/minute rating of the particular hydraulic system in which they are to be used. Other similar valves are available from other manufacturers. In this valve, the operating lever is spring biased to the "hold" or "off" position in which all flow through the valve is through the center with all ports closed. This is termed the normally open (N.O.) position. When the handle is moved in one direction or the other, oil in the center is diverted to the proper port to raise or lower the implement. Upon hand release, the valve lever returns to its spring biased position and the valve returns to its normally open (N.O.) position i.e., the "hold" or "off" position with respect to the hydraulic system.

If the lever is moved past the "down" position to a detent, the valve is placed in the "float" position in which all ports are open, allowing hydraulic fluid to surge back and forth as the cylinders move. When in this detent position, the valve lever must be manually moved before the valve can be changed to raise, lower, or be allowed to return to N.O.

In its most preferred form, free piston 76 preferably have about six times the working surface area of the working piston 92 in hydraulic cylinder 48. Also, preferably, the bore in which piston 76 moves in container 74 will preferably be about twice as long as the travel of piston 92 in hydraulic cylinder 48. For example, a system utilized on a dozer of the type shown in FIG. 1 with an earth compactor of the type also shown in the figure, utilizes a piston in hydraulic cylinder 48 which has a working area of about 20 square inches and a free piston 76 working area of about 120 square inches. In this arrangement, the predetermined pressure in chamber 80 was held at about 30 pounds per square inch.

The operation of the system is as follows. With manual valve 70 open and control valve 66 in the "float" position the compactor or other implement is free to float on the ground surface. If the operator desires more down-pressure on the implement, control valve 66 may be placed in the down position and the pressure on gauge 84 will be observed to rise, say from 30 pounds per square inch to 60. This causes a decrease in the volume of the biasing gas in the accumulator by about one-half. If manual valve 70 is now closed and control valve 66 is placed in the float position, the operator will now have a force of about 60 pounds per square inch on the 20 square inch working surface of piston 92 or about 1200 pounds of down-pressure on the end of the piston rod in hydraulic cylinder 48. The implement will now float or flex behind dozer 10 with a positive downpressure. To compensate for uneven ground, the hydraulic fluid will surge back and forth between working piston 92 and free piston 76 in accumulator 72 and reservoir 64.

In the example described above, the travel of piston 92 was about 8 inches. When the compactor and dozer are standing on level ground and the implement is in the "down" position, piston 92 is about midway in its travel distance. Since free piston 76 is about six times as large as working piston 92, it travels only about 1/6 as far as the working piston travels. Consequently, a maximum of 8 inch travel for working piston 92 will correspond to a travel of only about 1 and ⅓ inches for free piston 76. Effects on pressure in the accumulator will be small and negligible in this instance.

In the event that the initial air or gas biasing charge is not great enough to attain desired results, the charge may be raised as desired. However, it should not be raised to such a level as to raise the vehicle 10 from the ground. Also, the pressure in the accumulator should be maintained below the working pressure for which the hydraulic system of the vehicle is designed. Typical working systems have a working pressure of about 2200 pounds per square inch.

With such a control system as has been described above, after the biasing gas charge in the accumulator has been determined to suit working conditions, a machine operator may select the down-pressure of the vibrating compactor or other implement being utilized to suit the conditions of the job without leaving his seat on the vehicle.

Having described the invention, the embodiments thereof in which exclusive property rights are claimed are defined as follows:

I claim:

1. A vehicle-mounted earth working implement having means connecting the implement to the vehicle for positioning the implement in various positions relative to the ground including a ground working position, the connecting means including:

(a) hydraulic cylinder means connected between the vehicle and the implement whereby the implement may be raised from and lowered to the ground working position;

(b) a first hydraulic conduit means connected to the hydraulic cylinder means for supplying hydraulic fluid pressure thereto to raise the implement and second hydraulic conduit means connected to the hydraulic cylinder means for supplying hydraulic fluid pressure thereto to lower the implement;

(c) first valve means connected to the first and second hydraulic conduit means for controlling the supply of hydraulic fluid thereto and to the hydraulic cylinder means, the valve means being operable to selectively supply hydraulic pressure to either the first or the second hydraulic conduit means, to prevent the supply of hydraulic pressure to both of the hydraulic conduit means simultaneously or to supply hydraulic pressure to both of the hydraulic conduit means simultaneously;

(d) means connected to the first valve means for delivering hydraulic fluid under pressure thereto;

(e) second valve means, operable between open and closed positions, connected to the second hydraulic conduit means between the hydraulic cylinder means and the first valve means; and (f) hydraulic pressure accumulator means connected to the second hydraulic conduit line means between the hydraulic cylinder means and the second valve means for receiving hydraulic fluid pressure therefrom, the accumulator means including a pressure container, means dividing the container into a hydraulic fluid pressure chamber for receiving hydraulic fluid pressure from the second hydraulic conduit means and a bias pressure chamber, and means for providing a bias pressure to the bias pressure chamber, the container dividing means being positionally responsive to the hydraulic fluid pressure and the bias pressure to continuously seek a position in the container dependent on the bias pressure and the relative volumes of the two chambers are modified accordingly.

2. The invention defined in claim 1 wherein the dividing means in the accumulator chamber comprises a free piston.

3. The invention defined in claim 2 wherein the free piston in the accumulator means has about six times the working surface area of the hydraulic cylinder means.

4. The invention defined in claim 3 wherein the travel of the free piston is about 1/6 or less the travel of the hydraulic working cylinder means.

5. The invention defined in claim 4 wherein the working surface area of the free piston is about 120 square inches and the working surface area of the hydraulic cylinder means is about 20 square inches.

6. the invention defined in claim 4 wherein the pressure in the bias pressure chamber is about at least 30 pounds per square inch.

7. The invention defined in claim 3 wherein the working surface area of the free piston is about 120 square inches and the working surface area of the hydraulic cylinder means is about 20 square inches.

8. The invention defined in claim 7 wherein the pressure in the bias pressure chamber is about at least 30 pounds per square inch.

9. The invention defined in claim 3 wherein the pressure in the bias pressure chamber is about at least 30 pounds per square inch.

10. The invention defined in claim 2 wherein the travel of the free piston is about 1/6 or less the travel of the hydraulic working cylinder means.

11. The invention defined in claim 10 wherein the pressure in the bias pressure chamber is about at least 30 pounds per square inch.

12. The invention defined in claim 2 wherein the free piston in the accumulator means has a greater working surface area than that of the hydraulic working cylinder means.

13. The invention defined in claim 1 wherein the implement is an earth compactor.

14. The invention defined in claim 13 wherein the compactor is carried on a support frame and the hydraulic cylinder means comprises a pair of hydraulic cylinders connected between the vehicle and the support frame with one to each side of the compactor whereby leverage may be exerted on the compactor by the vehicle through the hydraulic cylinder means.

15. The invention defined in claim 13 wherein the compactor is mounted at the rear end of the vehicle.

16. The invention defined in claim 13 wherein the vehicle is self-propelled.

17. The invention defined in claim 16 wherein the compactor is mounted at the rear end of the vehicle as a supplemental implement relative to a primary implement carried at the front end of the vehicle.

18. The invention as defined in claim 13 wherein the compactor includes a vibrator.

19. The invention as defined in claim 13 including a pair of steering cylinders and hydraulic means for controlling them, the steering cylinders being positioned one to each side of the compactor.

20. The invention defined in claim 1 wherein the hydraulic cylinder means comprises a pair of hydraulic cylinders.

21. The invention defined in claim 1 wherein the pressure in the bias pressure chamber is compresed air.

22. The invention defined in claim 1 wherein the pressure in the bias pressure chamber is an inert gas under pressure.

23. An operating and down-pressure hydraulic assembly for a vehicle mounted earth compactor that is pivotable between at least a raised position and a ground working position, comprising:

(a) hydraulic cylinder means connected between the vehicle and the implement whereby the implement may be raised from and lowered to the ground working position;

(b) first and second hydraulic conduit means connected to the hydraulic cylinder means whereby hydraulic pressure of the first means causes the hydraulic cylinder means to raise the implement and hydraulic pressure in the second means causes the hydraulic cylinder means to lower the implement;

(c) first valve means connected to the first and second hydraulic conduit means for controlling the supply of hydraulic fluid thereto, the valve means being operable to selectively supply hydraulic pressure to the first or the second hydraulic conduit means, to prevent the supply of hydraulic pressure to both of the hydraulic conduit means simultaneously or to supply hydraulic pressure to both of the hydraulic conduit means simultaneously;

(d) means connected to the first valve means for delivering hydraulic fluid under pressure thereto;

(e) second valve means, operable between open and closed positions, connected to the second hydraulic conduit means between the hydraulic cylinder means and the first valve means; and (f) hydraulic pressure accumulator means connected to the second hydraulic conduit means between the hydraulic cylinder means and the second valve means, the accumulator means including a pressure container, means dividing the container into a hydraulic fluid pressure chamber for receiving hydraulic fluid pressure from the second hydraulic conduit means and a bias pressure chamber, and means for providing a bias pressure to the bias pressure chamber, the container dividing means being positionally responsive to the hydraulic fluid pressure and the bias pressure to establish a position in the container determined by the bias pressure and the hydraulic fluid pressure whereby the relative volumes of the two chambers are modified accordingly.

24. The invention defined in claim 23 wherein the dividing means in the accumulator chamber comprises a free piston.

25. The invention defined in claim 23 wherein the implement is an earth compactor.

26. The invention defined in claim 23 including a pair of steering cylinders and hydraulic means for controlling them, the steering cylinders being positioned one to each side of the compactor.

* * * * *

UNITED STATES PATENT AND TRADEMARK OFFICE

CERTIFICATE OF CORRECTION

PATENT NO. : 4,269,535
DATED : May 26, 1981
INVENTOR(S) : Gene Schultz

It is certified that error appears in the above-identified patent and that said Letters Patent are hereby corrected as shown below:

Column 6, line 1, after "76" insert --will--.

Column 7, line 59, "the" first occurrance should be --The--.

Column 8, line 40, after "1" insert --or 23--.

Column 8, line 41, "compresed" should be --compressed--.

Column 8, line 43, after "1" insert --or 23--.

Signed and Sealed this

*Eleventh* Day of *August 1981*

[SEAL]

*Attest:*

GERALD J. MOSSINGHOFF

*Attesting Officer*

*Commissioner of Patents and Trademarks*